United States Patent [19]

Sakaki et al.

[11] Patent Number: 4,955,180

[45] Date of Patent: Sep. 11, 1990

[54] METHOD AND APPARATUS FOR FEEDING AND TIGHTENING A BAND IN STRAPPING MACHINE

[75] Inventors: Yasunori Sakaki, Tokyo; Tsutomu Tagomori, Yokohama, both of Japan

[73] Assignee: Strapack Corporation, Tokyo, Japan

[21] Appl. No.: 207,584

[22] Filed: Jun. 16, 1988

[30] Foreign Application Priority Data

Jun. 18, 1987 [JP] Japan ..... 62-150206
Jun. 18, 1987 [JP] Japan ..... 62-150207

[51] Int. Cl.[5] ..... B65B 13/08; B65B 13/22; B65B 13/32

[52] U.S. Cl. ..... 53/399; 53/64; 53/589; 53/389; 100/2; 100/4; 250/231.13; 340/600

[58] Field of Search ..... 53/589, 399, 582, 64, 53/389; 100/2, 4, 17, 25, 29, 32; 74/114, DIG. 7; 340/555, 600, 679; 250/231 SE

[56] References Cited

U.S. PATENT DOCUMENTS

| | | | |
|---|---|---|---|
| 3,665,844 | 5/1972 | Clark | 100/4 |
| 4,195,291 | 3/1980 | Burks, Jr. | 340/600 X |
| 4,271,655 | 6/1981 | Nagayoshi | 53/589 X |
| 4,634,859 | 1/1987 | Martell | 250/231 SE |
| 4,635,541 | 1/1987 | Kasuga | 100/32 X |
| 4,724,659 | 2/1988 | Mori et al. | 53/589 |

*Primary Examiner*—Horace M. Culver

*Attorney, Agent, or Firm*—Schwartz & Weinrieb

[57] ABSTRACT

The present invention relates to a method and an apparatus for feeding and tightening a band wherein a touch roller is brought into compressive contact with a reverse rotation driving roller for a predetermined time when a signal for detecting a decrease in the speed of rotation including the stopping of a forward rotation touch roller is developed prior to the development of a signal for detecting the approach of the front end of the fed band to a mechanism for grasping the band front end; whereby the band is restored and the compressive contact of the reverse rotation touch roller is released after passage of the predetermined time so as to restore the band; the band is then restored by means of a tension roller which is rotated at a lower speed and driven at a higher torque as compared with the reverse rotation roller and a touch roller which is brought into compressive contact with and capable of separating from the tension roller; and the band is finally tightened by starting the reverse rotation of the tension after the reverse rotation touch roller is brought into slidable contact with the reverse rotation driving roller through the intermediary of the band and is rotated in subordination thereto and then by bringing the touch roller into compressive contact with the tension roller by means of the development of a signal for detecting a decrease in the speed of rotation including the stoppage of the reverse rotation touch roller.

17 Claims, 4 Drawing Sheets

METHOD AND APPARATUS FOR FEEDING AND TIGHTENING A BAND IN STRAPPING MACHINE

FIELD OF THE INVENTION

The present invention relates to a method and an apparatus for feeding and tightening a band within an automatic strapping machine wherein the main body of the strapping machine is provided with a band guiding arch, and wherein further a band which is narrow, soft, and inexpensive is accurately caused to travel within the band guide arch upon the main body of the strapping machine so as to transfer the front end of the band to a predetermined stopping position below a slide table, whereupon a signal for starting a band-tightening mechanism is produced and generated so as to instantly initiate the restoration of the strapping band arranged in the form of a loop around an article to be strapped by means of a pair of rollers for restoring the band and winding of the band around the article to be strapped, followed by more positively tightening the article to be strapped by means of the band subsequent to the band restoration, thereby enabling high-speed strapping.

BACKGROUND OF THE INVENTION

Within an apparatus for feeding and tightening a band in a conventional strapping machine, as illustrated in FIGS. 4 (A) to (D), a touch roller 13, that is, a follower roller which rotates in subordination to and in slidable contact with a driving roller 10 of a pair of rollers 10 and 13 for grasping and feeding the band through the intermediary of a bight portion thereof is eccentrically supported on a main shaft 9 by means of an eccentric shaft 6 projecting from one end of the main shaft 9, and the main shaft 9 is caused to rotate under the influence of the tension of a spring (not shown) which is provided for biasing downwardly with respect to FIG. 4 a weight 7 inserted into one end of an adjuster 3 fixedly inserted into the other end of the main shaft 9, whereby the eccentric shaft 6 of the touch roller 13 is pivotably rotated in the form of an arc and pressed upon the driving roller 10 connected to a driving mechanism (not shown) so as to press the band therebetween and thereby provide the frictional force necessary for feeding the band.

In such a way, the band is grasped only, under the influence of the gravity of the weight 7, the fixed position of the weight 7 upon the adjuster 3, or the drag of the spring (not shown), by means of the pair of rollers 10 and 13, which are rotated forwardly in the feeding direction of the band so as to feed the band into the band guide arch upon the outside of the main body of the strapping machine. The forward rotation time adjusted by means of a timer which is set to a time slightly longer than that during which the front end of the band approaches the lower portion of a slide table 8 or a slide table switch, which senses the approach of the front end of the band, provided upon the lower portion of the slide table 8 enables the front end of the band to be transferred to a predetermined position for starting restoration of the band, this is, to a left press 47 constituting a mechanism for grasping the band feeding end below the slide table 8 or to the upper portion of a right press 40 constituting a mechanism for grasping the front end of the band; or to a time at the completion of which the front end of the band reaches and actuates a braking mechanism such as, for example, an electromagnetic brake so as to stop the rotation of the driving roller 10.

Irrespective of the fact that the band has approached the lower portion of the slide table 8 when the band is fed as described above, the braking mechanism operated by means of the signal of the timer or the signal of the slide table switch below the slide table 8, within the period of time set by the timer, permits rotation of the driving roller 10 to continue during a predetermined period of time until the actual stopping of rotation of the driving roller 10. However, the follower touch roller 13 is stopped upon the driving roller 10 which continues rotation, whereby the compressive force of the touch roller 13 upon the driving roller 10 may be adjusted by means of the weight 7 acting upon the adjuster 3, the position of the weight 7 upon the adjuster 3, or the tension of the spring (not shown) so as to cause the driving roller 10 to slip against the band.

When the band becomes jammed within the band guide arch during feeding of the band, the pair of rollers 10 and 13 cause friction upon the same portion of the band because the band does not reach the slide table switch for actuating both the band-feeding time adjusted by means of the timer and the time at which the band-feeding is stopped by means of the switch. Accordingly, the jammed band portion is scraped, locally crushed and bent, whereby the band meanders vertically or horizontally such that the band is folded within a band chute 1 having a notch within the arch portion thereof and in which portions of the circumferences of the touch roller 13 and the driving roller 10 the band is likely to be present upon the subsequent band-feeding, that is, the so-called nipping state. Even when a band jam in which the band is folded thereby forming a multilayer band, there is a situation wherein stopping of the machine and manual restoration of the band cannot resolve the folding tendency thereof.

A narrow and soft band which is susceptible to tension and is in high demand from the standpoint of costs in recent years frequently provokes difficulties such as, for example, the locking of the front end of the band within the arch because of the localized crushing, bending and the right-and-left lateral movement as well as the vertical movement thereof.

As described above, when the front end of the band approaches the lower portion of the slide table 8, a right press grasps and fixes the front end of the band so as to restore the band into the main body. When the band is restored, that is, the pair of rollers 10 and 13 or another pair of rollers are reversely rotated, the right press ascends, as shown in FIG. 4, so as to grasp the band front end. In this case, a shaft spring 44 inserted and fixed upon a press shaft 43 which rotates in synchronism with the vertical movement of the right press 40 pivotably rotates the adjuster 3 counterclockwise with respect to FIG. 4, so as to pivotably rotate the touch roller 13 so as to increase the compressive contact with the driving roller 10 and thereby enhance the compressive force developed therebetween. A spring adjuster 45 is adapted to adjust the timing at which the shaft spring 44 pivotably rotates the adjuster 3.

There is a process in which the pair of rollers reversely rotate and the band is wound around the outer periphery of an article to be strapped or another process in which the band tightly binds the article to be strapped. During these processes, a mechanism for pivotably rotating the adjuster 3 by means of the shaft spring 44 upon the press shaft 43 enhances the compressive contact force upon the driving roller 13 by means of the touch roller 10 during the reverse rotation of the pair of touch rollers. In this case, the band is restored at a predetermined time through the intermediary of the timer so as to remove the band from the band guide arch and to wind the same around the article to be strapped. A signal produced when the predetermined time of the timer is completed stops the rotation of the driving roller 10 and a tension cam 42 simultaneously rotates so as to tighten the band through means of a predetermined stroke by means of a tension arm 41. Subsequent to the generation of the aforenoted signal, that is, the completion of the band restoration, the pair of rollers 10 and 13 or another pair of rollers are rotated in a low-speed high-torque mode through the intermediary of a differential speed-reducing mechanism, whereby the band is more firmly tightened and bound around the article to be strapped. The reverse rotation time set by means of the timer is adequately adjusted according to the expected minimum dimensions of the article to be strapped. The period comprising the predetermined time of the timer established by estimating the time of completion of restoration of the band, which is removed from the band guide of the band guide arch or from a freely opening and closing flap, to be wound around the article to be strapped, even when the band is wound around the article to be strapped, does not always start the tightening process in which the tension arm 41 or the pair of rollers 10 and 13 or another pair of rollers rotate in a low-speed high-torque mode through means of the intermediary of a differential speed-reducing mechanism, thereby resulting in considerable time loss for high-speed strapping in which as little as 1/10 second becomes a matter of concern. As described above, even if the band is wound around the article to be strapped a braking mechanism such as, for example, an electromagnetic brake is actuated within the period of time set by means of the timer or because of the generated signal of the timer so as to permit the rotation of the driving roller 10 to continue for a very short period of time until the rotation of the driving roller 10 is stopped. The shaft spring 44 is so adjusted that the follower touch roller 13 stops upon the driving roller 10 which continues rotation and the driving roller 10 then slips against the band. Accordingly, the pair of rollers 10 and 13 may, as is the case with the above described band-feeding, scratch the identical portion of the band, which is scraped, locally crushed, folded, and then moves in a right-and-left lateral direction as well as vertically, resulting of the band within folding-up in the band chute 1 and so-called nipping thereof so as to form a jam of the band. In this case, the folded or crushed band portion must be cut and thrown away.

OBJECTS OF THE INVENTION

It is an object of the present invention to solve the aforementioned, conventional drawbacks and in particular to enable band-feeding capable of feeding the band below the slide table even when a band which is susceptible to tension is caught within the arch portion thereof.

It is another object of the present invention to enable higher speed strapping by detecting the progress of the process from restoration to tightening of the band in terms of actual winding of the band around an article to be strapped and more particularly to prevent the band easily susceptible to tension from being damaged due to the slippage of the driving roller so as to avoid any impediment to the band-feeding.

SUMMARY OF THE INVENTION

In order to accomplish the above-described objects, when a signal for detecting a decrease in the speed of rotation, including the stopping of the forward rotation touch roller, develops prior to the development of a detecting signal for detecting the approach of the front end of the fed band toward the mechanism for grasping the band front end, the touch roller is brought into compressive contact with the reverse rotation driving roller for a predetermined period of time so as to restore the band and to subsequently release the compressive contact of the reverse rotation touch roller after the passage of the predetermined period of time. When the front end of the band collides with something or portions of the band guide arch or other structures in the above way so as to retard the band-traveling force, the rotation of the forward rotation touch roller slows down and finally stops. The signal for detecting a decrease in the speed of rotation of the forward rotation touch roller immediately brings the touch roller into compressive contact with the reverse rotation driving roller irrespective of the rotation of the forward rotation driving roller so as to restore the band for a predetermined short period of time and subsequently to release the compressive contact of the touch roller, whereby the band is furnished with the traveling force of the forward rotation driving roller and the forward rotation touch roller so as to properly feed the band.

The forward and reverse rotation driving rollers are selectively brought into compressive contact with or separated from the forward and reverse rotation touch rollers which perform subsidiary rotation functions as a result of being in slidable contact with the forward and reverse rotation driving rollers through the intermediary of the band thereby feeding the band toward the outside of the main body, respectively, so as to restore the band. In addition, the band is tightened by means of a tension roller, which is rotated and driven at a lower speed and higher torque as compared with the reverse rotation driving roller, and a touch roller which is freely brought into contact with and separated from the tension roller.

The band-feeding and tightening apparatus is so constructed that means for producing a signal for detecting a decrease in the speed of rotation including the stopping of the reverse rotation touch roller and the tension roller starts reverse rotation at a predetermined time after the reverse rotation driving roller is brought into slidable contact with the reverse rotation touch roller through the intermediary of the band so as to cause subsidiary rotation, and the development of a signal for detecting a decrease in the speed of rotation including the stopping of the reverse rotation touch roller, brings the touch roller into compressive contact with the tension roller. The signal for detecting the decrease in the speed of the rotation of the reverse rotation touch roller for a period of time when the band is restored by means of the reverse rotation driving roller and the reverse rotation touch roller so as to wind the same around an article to be strapped and for detecting the fact that the rotation of the reverse rotation touch roller is decreasing and finally stops (completion of the restoration) brings the tension touch roller into compressive contact with the tension roller which starts rotation at the same time of and after the above rotation of the reverse rotation driving roller and rapidly facilitates the band-tightening process, by which the band is tightened and the compressive contact of the tension roller is released thus completing the tightening process.

BRIEF DESCRIPTION OF THE DRAWINGS

Various other objects, features, and attendant advantages of the present invention will be more completely understood when reference is made to the following detailed description, when considered in connection with the accompanying drawings, in which like reference characters designate like or corresponding parts throughout the views, and wherein:

FIGS. 1 to 3 illustrate one embodiment of the present invention, wherein;

FIG. 1 is a front view of the main parts of the strapping machine;

FIG. 2 (A) is a schematic diagram taken along arrow marks 2A—2A in FIG. 1;

FIG. 2 (B) is a schematic diagram taken along arrow marks 2B—2B in FIG. 1;

FIG. 3 is a partial cross-sectional view;

FIGS. 4 (A) to 4 (D) show a conventional prior art apparatus wherein

FIG. 4 (A) is an entire perspective view of a mechanism for feeding, tightening, and fusing a band, FIG. 4 (B) is an exploded perspective view showing the respective press members, FIG. 4 (C) is a perspective view of an apparatus for feeding and restoring the band, and FIG. 4 (D) is an exploded perspective view of the apparatus for feeding and restoring the band.

DETAILED DESCRIPTION OF THE PREFERRED EMBODIMENT

Figure 1:
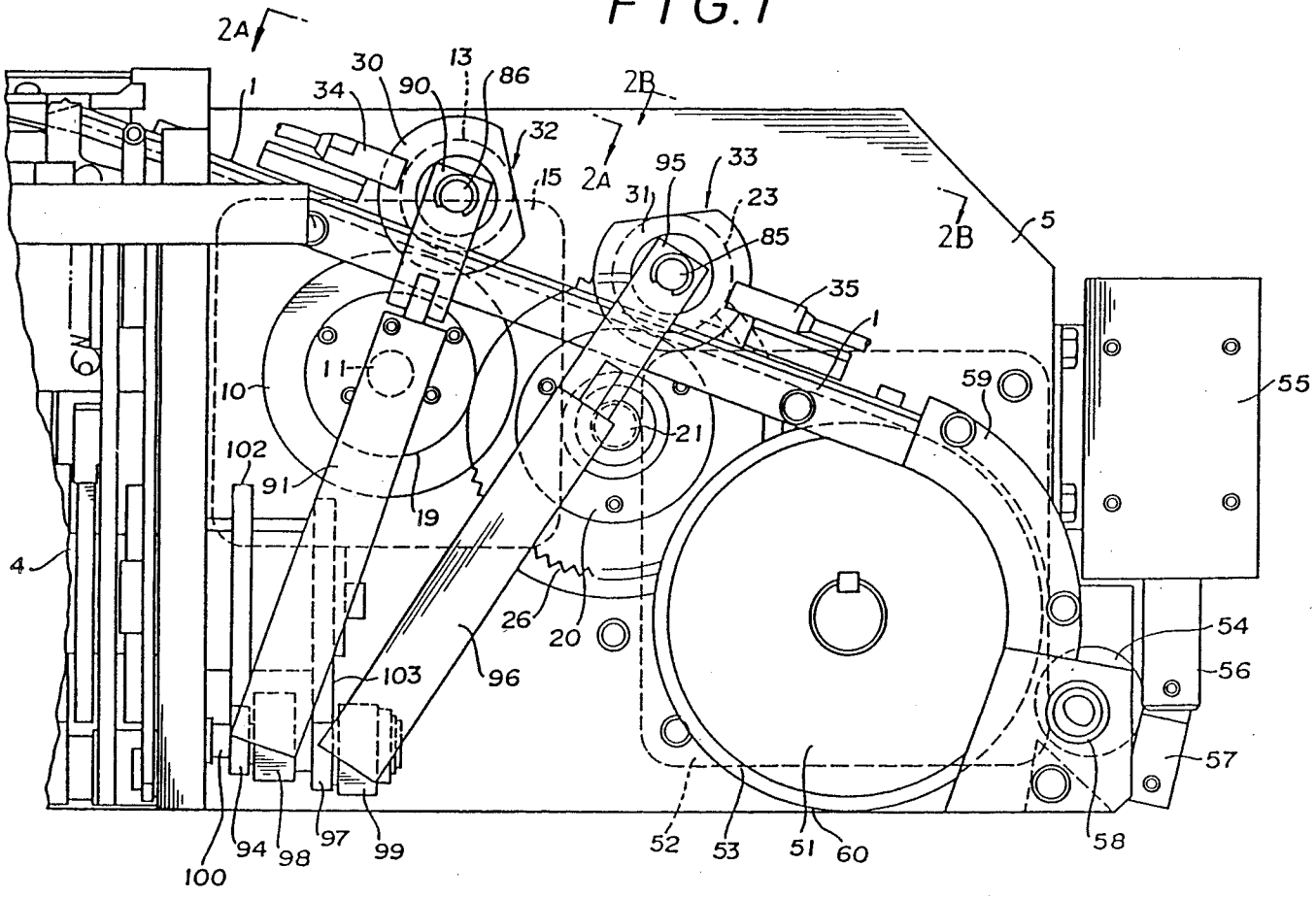

The mechanism is provided with a forward driving roller 10 which faces the band chute 1 and with a reverse rotation driving roller 20 spaced at a predetermined distance with respect thereto. A reduction motor 15 is directly connected to the drive shaft 11 of the forward rotation driving roller 10, and a gear 19 attached to the drive shaft 11 is meshed with a gear 26, of greater diameter than that of the gear 19, connected to the shaft 21 of the reverse rotation driving roller 20. Accordingly, the forward rotation driving roller 10 and the reverse rotation driving roller 20 always rotate in directions opposite to each other.

Figure 3:
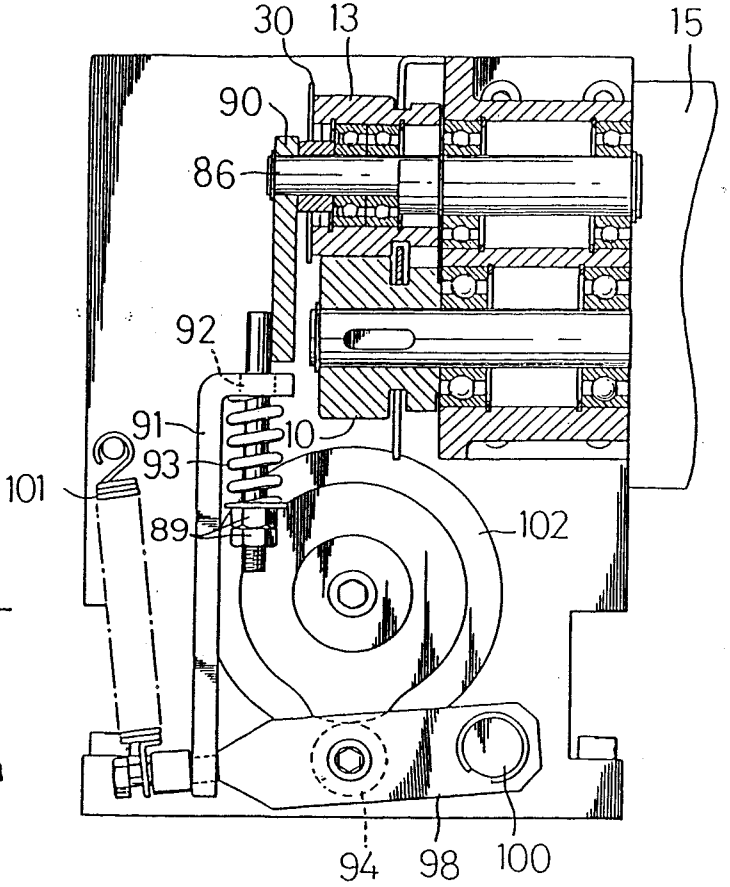

Numerals 13 and 23 denote forward and reverse rotation touch rollers which are idle rollers and have a similar structure. The structure related to both touch rollers is described with reference to FIG. 3 showing the actuating mechanism of the forward rotation touch roller 13. Both of the touch rollers are supported by means of eccentric shafts 86 and 85, to the ends of which the upper ends of actuating levers 90 and 95 are pivotally attached. The lower ends of these levers 90, 95 are loosely inserted into holes 92 bored through the bent sections of L-shaped interlocking levers 91 and 96 and connected to the actuating levers 90 and 95 through the intermediary of a spring 93. The lower ends of the actuating levers 90 and 95 are attached to the tips of arm levers 98 and 99 having rolls 94 and 97. One end of the arm levers 98 and 99 are pivotally supported by means of a shaft 100 projecting outwardly from a base plate, and a spring 101 is secured to the other end thereof so as to energize the spring in the direction of the band chute 1.

Cams 102 and 103 are mounted upon a shaft which is an extension of a cam shaft 40 for actuating a band fusion mechanism composed of a known band gripper, a heater and a center press, and are brought into contact with the rolls 94 and 97 of the arm levers 98 and 99, respectively, so as to perform an interlocking action with the interlocking levers 91 and 96, or the actuating levers 90 and 95.

The compressive contact force developed by means of the actuating levers 90 and 95 which bring a forward rotation touch roller 13 and a reverse rotation touch roller 23 into compressive contact with the forward rotation driving roller 10 and the reverse rotation driving roller 20 by means of the cams 102 (and 103) through the intermediary of the interlocking levers 91 and 96 is variable to some degree by adjusting the drag or biasing force of the springs 93 and (and 93) by rotating nuts 89 (and 89) disposed upon the lower portions of the springs 93 (and 93) and externally connected to the lower ends of the actuating levers 90 and 95. However a predetermined degree of resistance applied to the band which travels or is restored reduces the speed of the rotation of the forward rotation touch roller 13 and the reverse rotation touch roller 23 and the forward rotation driving roller 10 and the reverse rotation driving roller 20 finally slip against the band thereby stopping the forward rotation touch roller 13 and the reverse rotation touch roller 23.

The above-described resistance actually refers to that produced when the front end of band fed into forward rotation driving roller 10 and the forward rotation touch roller 13 is caught within the arch or abuts against a slide table switch and also refers to that produced when the band is removed from the arch and wound around an article to be strapped because of the reverse rotation of the reverse rotation driving roller 20 and the reverse rotation touch roller 23.

Figure 2A:
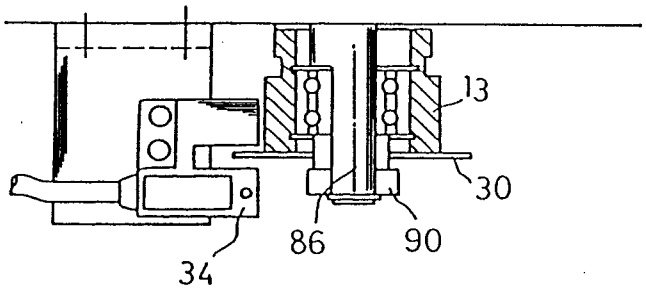
Figure 2B:
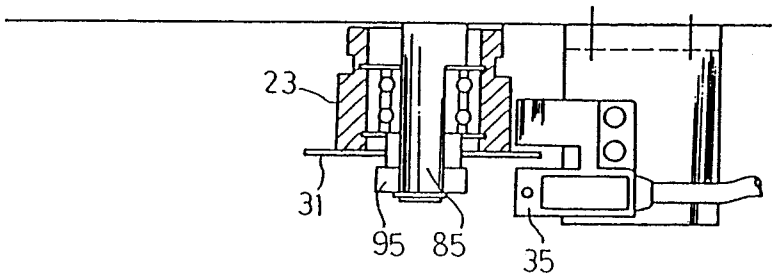
Figure 4A:
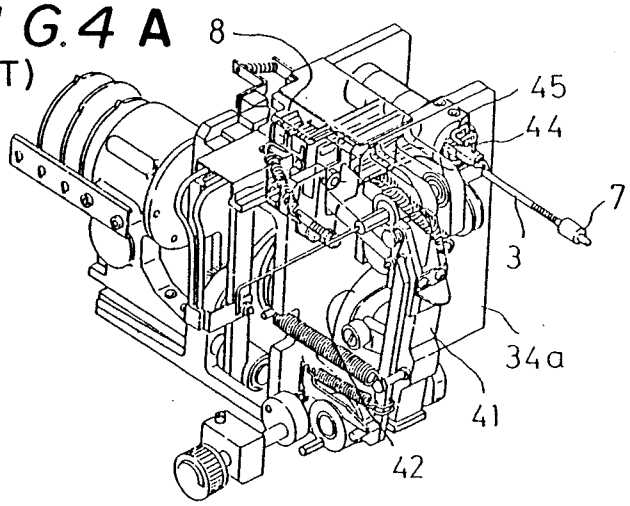
FIG.4A (PRIOR ART)
Figure 4B:
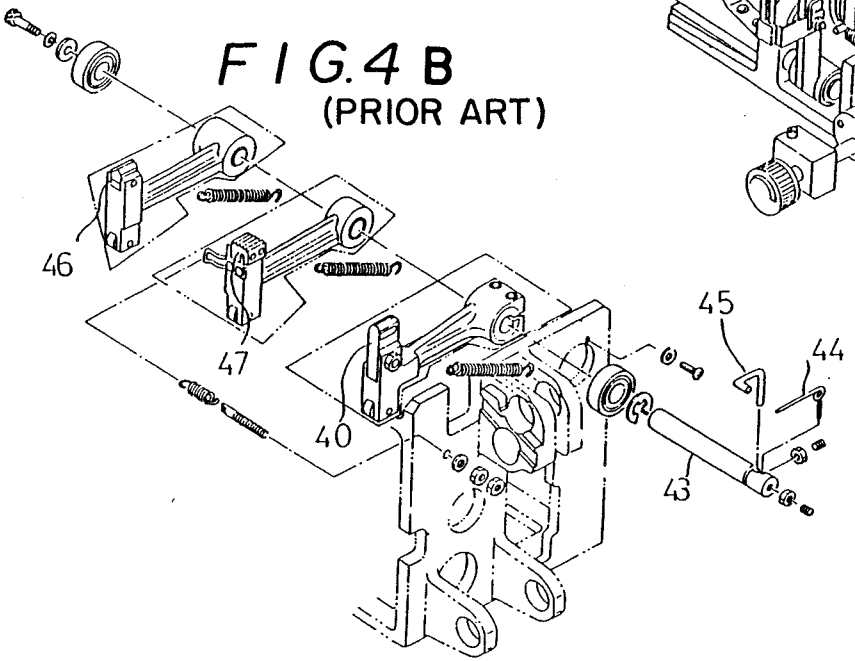
FIG.4B (PRIOR ART)
Figure 4D:
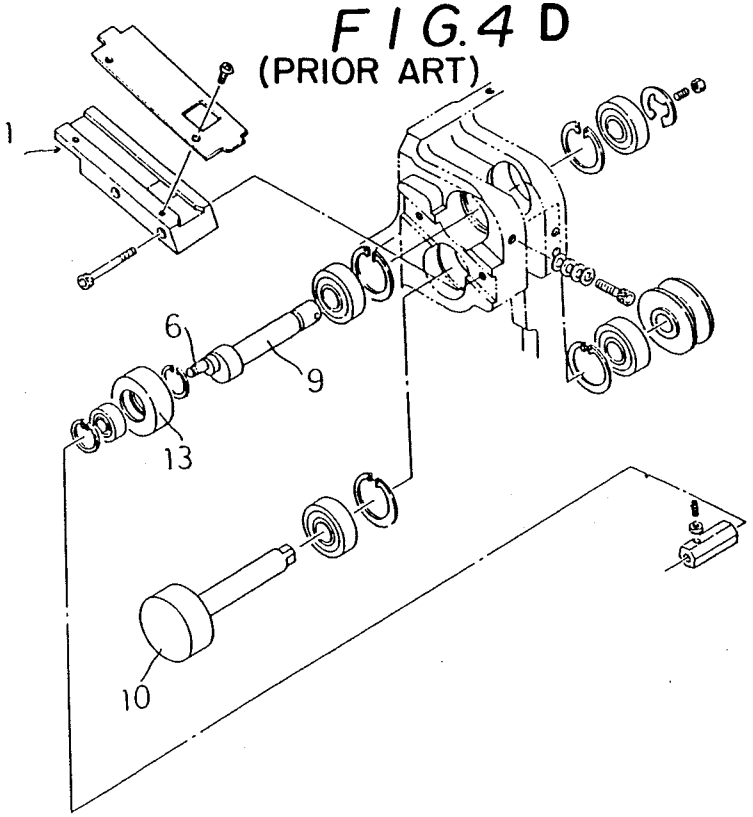
FIG. 4D (PRIOR ART)
Figure 4C:
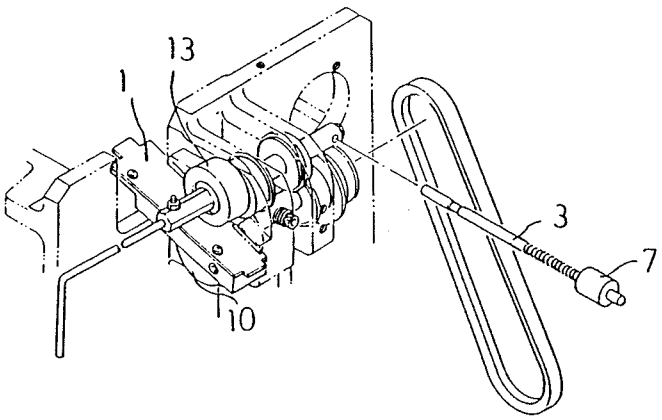
FIG. 4C (PRIOR ART)

Referring to FIGS. 1 to 3, the forward rotation touch roller 13 and the reverse rotation touch roller 23 are provided with rotary disks 30 and 31 which are partially cut-away, arc-shaped pulse-generating plates, and means 34 and 35 for detecting the speed of rotation, which are pulse generators integral therewith, are disposed at the rotation loci of the cut-away portions 32 and 33 of the rotary disks 30 and 31. The means for detecting the speed of rotation 34 and 35 are an access sensor, wherein a pulse is developed by turning the means ON when the cut-away portions 32 and 33 pass between the high-frequency-wave transmitting portion and the high-frequency-wave receiving portion of the means for detecting the speed of rotation 34 and 35 and the pulse is discharged from the capacitors respectively connected thereto, the same being finally charged by means of the respective capacitors by turning the means OFF when portions except for the cut-away portions 32 and 33 of the rotary disks 30 and 31 pass between the transmitting portion and the receiving portion. When the interval during which the pulses of the means for detecting the speed of rotation 34 and 35 are produced becomes longer, the rotating speed-detecting means 34 and 35 are turned OFF and the capacitors-charging quantity exceeds the capacity to form an electronic circuit for developing the signal. The signal of the rotation speed-detecting means 34 turns ON a solenoid for bringing the band-tightening driving roller described later into contact or out of contact with the touch roller. The period during the development of the signal is arbitrarily adjusted by varying the capacity of the capacitor.

A portion of the circumference of a tension roller 51 which is a band-tightening reverse rotation driving roller is disposed upon the rear end portion of the band chute 1 and is so constructed as to rotate at a lower speed and higher torque than the reverse rotation driving roller 20 which rotates at a lower speed and higher torque than that of the forward rotation drive roller 10.

A portion of the circumference of the tension roller 51 corresponding to the above-described return roller is disposed at the rear end of the band chute 1 and the drive shaft 22 of the tension roller 51 is directly connected to a tightening motor 52 composed of a brake-equipped geared motor attached to the reverse side of a base plate 5. As shown in FIG. 1, the tension roller 51 is a large-diameter roller which is fabricated from an elastic material which exhibits large friction resistance, such as, for example, urethane (hereinafter called "elastic body"), and is adhered to the outer periphery of the metallic roller. The center region, as seen in the width direction of the outer peripheral surface of the elastic body 51 is provided with a notch 53 within which an annular member 60 comprising a thrust washer formed by coating a metal material which is harder and has a smaller friction resistance than that of the elastic body, such as, for example, stainless steel is embedded. The annular member 60 projects outwardly from the outer periphery of the elastic body 51 by means of a slight distance such as, for example, 0.2 to 0.3 mm.

A tension touch roller 54 is supported by means of eccentric shaft 58, and the other end of a crank 57, one end of which is connected to the rod 56 of a solenoid 55, is connected to the head of the eccentric shaft 58. The outer periphery of the tension touch roller 54 is so constructed as to be capable of achieving compressive contact with and separation from the outer periphery of the tension roller 51 by means of expansion and contraction of the rod 56.

A guide chute 59 covers a portion of the outer periphery of the tension roller 51 through the intermediary of a gap for allowing the band to pass therethrough. One end of thereof faces the rear end of the band chute 1 and the other end thereof faces a portion of the outer periphery of the tension touch roller 54.

A timer $T_1$ is set to a time necessary for firmly tightening the band wound around the article to be strapped and a timer $T_2$ is set to a very short period of time, such as, for example, 1 second.

The band is wound around an article to be strapped through means of a band guiding arch (not shown) disposed upon the main body of a strapping machine or manually and the leading end of the band reaches a slide table 8. Because the convex portion of the cam 102 is not disposed at a position at which the same biases the roll 94 downwardly, a gap having a thickness at least exceeding the thickness of the band is defined between the forward rotation driving roller 10 and the forward rotation touch roller 13, such that there is no effect upon the band within the band chute 1. The relation between the reverse rotation driving roller 20 and the reverse rotation touch roller 23 is also the same as noted above with respect to rollers 10 and 13. In this case, a cam shaft 4 is pivotally rotated by means of a starting switch and the leading end of the band is grasped by means of the mechanism for holding the band leading end within the band fusion-bonding mechanism. Because of the cam which is simultaneously rotating, the actuating lever 95 is moved downwardly through the intermediary of the roll 97, the arm lever 99, and the interlocking lever 96. The eccentric shaft pivotably rotates in the form of an arc so as to move the reverse rotation touch roller 23 downwardly by means of the eccentric shaft thereby bringing the same into compressive contact with the reverse rotation driving roller 20. Accordingly, the band-feeding end within the band chute 1 is restored by means of a pair of rollers at high speed (the primary tightening).

The tension roller 51 has already started rotation by means of the tightening motor 52 at the same time that band restoration by means of the reverse rotation driving roller 20 and the reverse rotation touch roller 23 is occurring. The restored band travels while smoothly sliding around the annular member 60, having a low friction coefficient disposed within the outer periphery of the elastic body 53 of the tension roller 51 within the guide chute 59.

When the band is removed form the arch so as to be wound around the article to be strapped, the reverse rotation touch roller 23 applies resistance to the band against the reverse rotation movement, such that the rotation is gradually slowed down and the rotation speed of the rotary disk 31 is reduced. When the pulse-developing interval defined by means of the rotation speed-detecting means 35 becomes longer and the charging quantity into the capacitor exceeds an arbitrarily adjusted capacity, a signal is produced and the signal excites the solenoid 55 through the intermediary of the timer $T_1$ whereby the tension touch roller 54 upon the eccentric shaft 58 is brought into compressive contact with the tension roller 51 through the intermediary of the crank 57. In this case, the annular member 60 upon the elastic body 53 is pressed into the elastic body 53 through the intermediary of the band at a position at which the tension touch roller 54 is brought into contact with the elastic body 53 because of the compressive contact of the tension touch roller 54 and upon the peripheral surface on which the band is wound around the elastic body 53 whereby the band is tightened by means of the peripheral surface having the elastic body of a large friction resistance during a predetermined period of time of timer $T_1$.

When the band is firmly wound around the article to be strapped the aforesaid timer T produces a tightening completion signal by means of a timing-out operation, which causes the tightening motor 52 to stop. The cam shaft 4 rotates again so as to grasp the band-feeding end and to terminate the excitation of the solenoid 55. The rotation of the cam shaft 4 swings the arm lever 99 whereby the compressive contact of the reverse rotation touch roller 23 with the reverse rotation driving roller 20 is relieved so as to form a gap to such a degree that there is freedom of contact within the band between the respective rollers in the band chute 1. The cam shaft 4 which continues rotation performs fusion of the band-joining portion and cutting of the supplying end by means of the band fusion mechanism. Rotation of the cam shaft 4 relieves the compressive contact of the reverse rotation driving roller 20 and the reverse rotation touch roller 23 with the band. Rotation of the cam shaft 4 disposes the forward driving roller 10 and the forward rotation touch roller 13 toward the state as shown in FIG. 3 whereby the cam can compressively contact the band between both rollers and thereby feed a predetermined amount of the band to the upper surface of the main body.

When the leading end of the band abuts against the slide table switch disposed upon the lower portion of the slide table 8, the switch signal causes the cam shaft 4 to rotate again and stop at a point where the respective members return to their original positions. In the meantime, the leading end of the band which abuts against the slide table switch applies resistance to the forward rotation of the forward rotation touch roller 13, whereby the rotation speed of the forward rotation touch roller decreases and the forward rotation driving roller 10 eventually slips against the band so as to stop the forward rotation touch roller 13. No excess band is fed during this period whereby the system is capable of avoiding failures such as, for example, clogging of the band within the arch.

The slippage of the forward rotation driving roller 10 and the decrease in the speed of rotation of the forward rotation touch roller 13 leading to the stopping thereof extend the interval between the pulse development of the rotation speed-detecting means 34 and turning the slide table switch ON, such discharging the capacitor, which is then reset.

When the band is fed by means of the forward rotation of the forward rotation driving roller 10 and the forward rotation touch roller 13, the front end of the band is grasped somewhere within the arch. When resistance is applied to the band, the speed of rotation of the forward rotation touch roller 13 decreases so as to prolong the pulse-developing interval for delivering the signal through the intermediary of the capacitor. The signal causes the tightening motor 52 to reversely rotate so as to actuate the solenoid 55 of the tension touch roller 54 through the intermediary of the timer $T_2$ and thereby energize the solenoid 55 for approximately 1 second which is the setting time of the timer $T_2$.

The reverse rotation of the tension roller 51 by means of the motor 52 overcomes the forward rotation of the forward rotation driving roller 10 which slips against the band because of a lower speed and a higher torque thereof than that of the forward rotation drive roller 10 as is the case with the reverse rotation drive roller 20 so as to slightly restore the band into the main body thereof by means of the tension roller 51 and the touch roller 54. In this case, the leading end of the band locked within the arch is restored from the locking portion to the rear of the band-traveling direction. The timing-out of the timer $T_2$ intercepts the energization of the tightening motor 52 and the solenoid 55, whereby the band is provided with the traveling force of the forward rotation driving roller 10 and the forward rotation touch roller 13 which continues rotation, whereby the band again travels within the arch at a high rate of speed and then approaches the lower portion of the slide table. An electronic circuit is so constructed that the band restoration of the tension roller 51 and the touch roller 54 by means of the tightening motor 52 and the solenoid 55 is, when the rotation speed-detecting means 34 again detects a decrease in the rotation speed up to the stoppage of the forward rotation touch roller 13, repeatedly performed and the rotation of the speed reducer-equipped motor 15 is stopped and is externally displayed (by an abnormality display lamp) when repetition of a predetermined number of the above band restoration cycles develops the detection signal.

Although the tension roller 51 is used for the reverse rotation driving roller in the above embodiment and the touch roller 54 is brought into compressive contact with the tension roller 51 by means of the solenoid for a predetermined period of time so as to slightly restore the band, the reverse rotation driving roller 20 driven by means of the gear 26 may be used for the above-described reverse rotation driving roller so as to provide the solenoid in the reverse rotation touch roller 23 independent of the cam 103. The cam 102 may be rotated during the energization of the above solenoid so as to release the compressive contact of the forward rotation touch roller 13 with the forward rotation roller 10 such that the cam 102 is returned to the original position simultaneously with the turning OFF of the solenoid so as to again provide the band with the necessary traveling force.

When the slide table switch is turned ON by means of the leading end of the supplied band to complete the band so as feeding, a limit cam (not shown) can be interlocked with the cam shaft 4 so as to turn OFF a clutch which transmits the rotation of the motor to the cam shaft 4 through the intermediary of a speed reducer, whereby the rotation of the cam shaft 4 is stopped so as to return the respective mechanism to the original positions.

Obviously, many modifications and variations of the present invention are possible in light of the foregoing teachings. It is therefore to be understood that within the scope of the appended claims, the present invention may be practiced otherwise than as specifically described herein.

What is claimed is:

1. A method for feeding and tightening a band in a strapping machine, comprising the steps of:

feeding said band in a forward direction, so as to encircle an article to be strapped, by means of a forward rotating driving roller and a forward rotation touch roller, detecting a decrease in rotational speed of said forward rotation touch roller as may result from said band encountering an obstacle along its feeding path during said feeding of said band in said forward direction while encircling said article to be strapped;

generating a control signal in response to said detection of said decrease in rotational speed of said forward rotation touch roller;

actuating a reverse rotation driving roller and a reverse rotation touch roller in response to said control signal so as to retract said fed band away from said obstacle in a reverse direction along said feeding path; and deactuating said reverse rotation driving roller and said reverse rotation touch roller after a predetermined period of time so as to permit said forward rotation driving roller and said forward rotation touch roller to again feed said band in said forward direction.

2. A method in accordance with claim 1, wherein:

said predetermined period of time is approximately one second.

3. Apparatus for feeding and tightening a band in a strapping machine, comprising:

a forward rotation driving roller and a forward rotation touch roller, in operative contact with said forward rotation driving roller, for feeding said band in a forward direction so as to encircle an article to be strapped;

means for detecting a decrease in rotational speed of said forward rotation touch roller as may result from said band encountering an obstacle along its feeding path during said feeding of said band in said forward direction while encircling said article to be strapped;

means for generating a control signal in response to said detection of said decrease in rotational speed of said forward rotation touch roller;

means for actuating a reverse rotation driving roller and a reverse rotation touch roller, in operative contact with said reverse rotation driving roller, in response to said control signal so as to retract said fed band away from said obstacle in a reverse direction along said feeding path; and means for deactuating said reverse rotation driving roller and said reverse rotation touch roller after a predetermined period of time so as to permit said forward rotation driving roller and said forward rotation touch roller to again feed said band in said forward direction.

4. An apparatus in accordance with claim 3 wherein said forward rotation touch roller is provided with a rotary disk which is a pulse-generation plate in the form of a cut-away arc integral therewith, and said means for detecting the speed of rotation of said forward rotation touch roller is a pulse generator which is disposed along the rotation locus of the cut-away portion of the rotary disk.

5. An apparatus in accordance with claim 4 wherein said means for detecting the speed of rotation of said forward rotation touch roller is an access sensor.

6. An apparatus in accordance with claim 5, wherein said access sensor comprises:

a high-frequency wave-transmitting portion;

a high-frequency wave-receiving portion; and capacitor means operatively connected to an electronic circuit within which said high-frequency wave-transmitting portion and said high-frequency wave-receiving portion are disposed such that said access sensor is turned OFF when a portion, except for the cut-away portion of the rotary disk, passes between the high-frequency wave-transmitting portion of said sensor and the high-frequency wave-receiving portion of said sensor thereby charging said capacitor means whereby said control signal is produced when the charged quantity exceeds the capacity to complete said electronic circuit for developing said control signal.

7. An apparatus in accordance with claim 6 wherein the time period for developing the control signal is made adjustable by varying the capacity of the capacitor means.

8. Apparatus as set forth in claim 3, wherein:

said forward rotation driving roller has a gear disposed thereon which is engaged with a gear disposed upon said reverse rotation driving roller such that said forward rotation driving roller and said reverse rotation driving roller rotate in opposite directions.

9. Apparatus as set forth in claim 8, wherein:

said gear disposed upon said reverse rotation driving roller is larger in diameter than that of said gear disposed upon said forward rotation driving roller.

10. Apparatus as set forth in claim 3, further comprising:

solenoid means for actuating said reverse rotation touch roller into said operative contact with said reverse rotation driving roller while simultaneously removing said forward rotation touch roller from said operative contact with said forward rotation driving roller when said solenoid means is ON, and for actuating said forward rotation touch roller into said operative contact with said forward rotation driving roller while simultaneously removing said reverse rotation touch roller from said operative contact with said reverse rotation driving roller when said solenoid means is OFF.

11. A method for feeding and tightening a band in a strapping machine, comprising the steps of:

feeding said band in a forward direction, so as to encircle an article to be strapped, by means of a forward rotation driving roller and a forward rotation touch roller;

retracting said band in a reverse direction by means of a reverse rotation driving roller and a reverse rotation touch roller, after said band has completely encircled said article to be strapped, so as to preliminarily tighten said encircled band about said article being strapped;

detecting a decrease in rotational speed of said reverse rotation touch roller as a result of said preliminary tightening of said band about said article being strapped;

generating a control signal in response to said detection of said decrease in rotational speed of said reverse rotation touch roller; and actuating a reverse rotation tensioning roller and a reverse rotation tensioning touch roller in response to said control signal so as to finalize tightening of said band about said article being strapped.

12. Apparatus for feeding and tightening a band in a strapping machine, comprising:

a forward rotation driving roller and a forward rotation touch roller, in operative contact with said forward rotation driving roller, for feeding said band in a forward direction so as to encircle an article to be strapped;

a reverse rotation driving roller and a reverse rotation touch roller, in operative contact with said reverse rotation driving roller, for retracting said band in a reverse direction after said band has completely encircled said article to be strapped so as to preliminarily tighten said encircled band about said article being strapped;

means for detecting a decrease in the rotational speed of said reverse rotation touch roller as a result of said preliminary tightening of said band about said article being strapped;

means for generating a control signal in response to said detection of said decrease of said rotational speed of said reverse rotation touch roller; and reverse rotation tensioning roller means and reverse rotation tensioning touch roller means, in operative contact with said reverse rotation tensioning roller means, for retracting said band still further in said reverse direction, in response to said control signal, so as to finalize tightening of said band about said article being strapped.

13. Apparatus as set forth in claim 12, further comprising:

solenoid means for actuating said reverse rotation tensioning touch roller into said operative contact with said reverse rotation tensioning roller while simultaneously removing said forward rotation touch roller from said operative contact with said forward rotation driving roller when said solenoid means is ON, and for actuating said forward rotation touch roller into said operative contact with said forward rotation driving roller while simultaneously removing said reverse rotation tension touch roller from said operative contact with said reverse rotation tensioning roller when said solenoid means is OFF.

14. Apparatus as set forth in claim 12, wherein:

said reverse rotation touch roller is provided with a rotary disk which is a pulse-generation plate in the form of a cut-away arc integral therewith, and said means for detecting the speed of rotation of said reverse rotation touch roller is a pulse generator which is disposed along the rotation locus of said cut-away portion of said rotary disk.

15. Apparatus as set forth in claim 14, wherein said means for detecting said speed of rotation of said reverse rotation touch roller is an access sensor.

16. Apparatus as set forth in claim 15, wherein said access sensor comprises:

a high-frequency wave-transmitting portion;

a high-frequency wave-receiving portion; and capacitor means operatively connected to an electronic circuit within which said high-frequency wave-transmitting portion and said high-frequency wave-receiving portion are disposed such that said access sensor is turned OFF when a portion, except for said cut-away portion of said rotary disk, passes between said high-frequency wave-transmitting portion of said sensor and said high-frequency wave-receiving portion of said sensor thereby charging said capacitor means whereby said control signal is produced when the charged quantity exceeds the capacity to complete said electronic circuit for developing said control signal.

17. Apparatus as set forth in claim 16, wherein:

the time period for developing said control signal is made adjustable by varying the capacity of said capacitor means.

* * * * *